US007275339B1

(12) United States Patent
Cunningham et al.

(10) Patent No.: US 7,275,339 B1
(45) Date of Patent: Oct. 2, 2007

(54) PAN FACE SIGN CONSTRUCTION AND METHOD OF MAKING PAN FACE SIGNS

(76) Inventors: Roger D. Cunningham, 10233 Tims Lake Blvd., Grass Lake, MI (US) 49240; Russell Govette, 617 Opdyke Rd., Auburn Hills, MI (US) 48326

( * ) Notice: Subject to any disclaimer, the term of this patent is extended or adjusted under 35 U.S.C. 154(b) by 0 days.

(21) Appl. No.: 11/209,952

(22) Filed: Aug. 23, 2005

Related U.S. Application Data

(60) Provisional application No. 60/603,902, filed on Aug. 23, 2004.

(51) Int. Cl.
*G09F 7/00* (2006.01)

(52) U.S. Cl. ..... 40/584; 40/549

(58) Field of Classification Search ..... 40/584, 40/800, 575, 549, 790; 29/450; 428/14
See application file for complete search history.

(56) References Cited

U.S. PATENT DOCUMENTS 367,899 A * 8/1887 Ecker ..... 40/800
2,193,058 A * 3/1940 Carver ..... 40/579
2,387,475 A * 10/1945 Stokoe ..... 428/14
2,540,271 A * 2/1951 Lytton ..... 40/545
2,769,263 A * 11/1956 Wamser ..... 40/574
2,836,913 A * 6/1958 Thomson et al. ..... 40/553
3,023,524 A * 3/1962 Muse ..... 40/574
3,593,447 A * 7/1971 Winegarten ..... 40/564
4,021,949 A * 5/1977 Niehaus et al. ..... 40/361
5,186,499 A * 2/1993 Mason ..... 283/81
5,720,480 A * 2/1998 Lawlor et al. ..... 273/118 A
5,781,980 A * 7/1998 Golston ..... 29/450

* cited by examiner

*Primary Examiner*—William L. Miller
(74) *Attorney, Agent, or Firm*—James M. Deimen

(57) ABSTRACT

A new pan face sign construction comprises an opaque frame of extruded structural plastic and a pan face of clear plastic, such as acrylic or polycarbonate. Corners of the frame are simply mitered with a common miter saw and the frame pieces and pan face assembled with a suitable liquid plastic adhesive. The new pan face sign construction allows the sign lettering and graphics to be printed on the flat backside of the pan face with a modern ink jet printer and ultraviolet cured inks prior to assembly. After printing, the frame is assembled to the pan face and the sign is ready for installation.

4 Claims, 2 Drawing Sheets

PAN FACE SIGN CONSTRUCTION AND METHOD OF MAKING PAN FACE SIGNS

BACKGROUND OF THE INVENTION

This application claims the benefit of provisional patent application No. 60/603,902, filed Aug. 23, 2004.

The field of the invention pertains to signs and illuminated signs and, in particular, to signs having the graphics and text portion extended outward in front of the metal supporting frame. Such signs are commonly called pan face signs.

Conventional pan faced signs are constructed by modestly heating a sheet of rigid polycarbonate plastic, placing the sheet over a vacuum-forming mold and drawing the sheet down into the mold. After cooling, the graphics and text are added by applying paint, ink or vinyl pieces to the outside surface of the sheet. This construction requires a large heating oven and large vacuum-forming molds.

With a view toward eliminating the need for the specialized oven and vacuum-forming molds for making pan face signs, applicant has developed the following construction and method that only requires tools found in a typical sign shop.

SUMMARY OF THE INVENTION

The new pan face sign construction comprises an opaque or translucent frame of extruded structural plastic and a pan face of clear plastic, such as acrylic or polycarbonate. Corners of the frame are simply mitered with a common miter saw and the pan face and frame pieces assembled with a suitable liquid plastic adhesive.

The new pan face sign construction allows the sign lettering and graphics to be printed on the flat, clear pan face backside with a modern ink jet printer and ultraviolet cured inks. With the backside printing, the lettering and graphics are protected from weather and flying debris. After printing, the frame is assembled to the pan face and the sign is ready for installation.

DESCRIPTION OF THE PREFERRED EMBODIMENT

Figure 1:
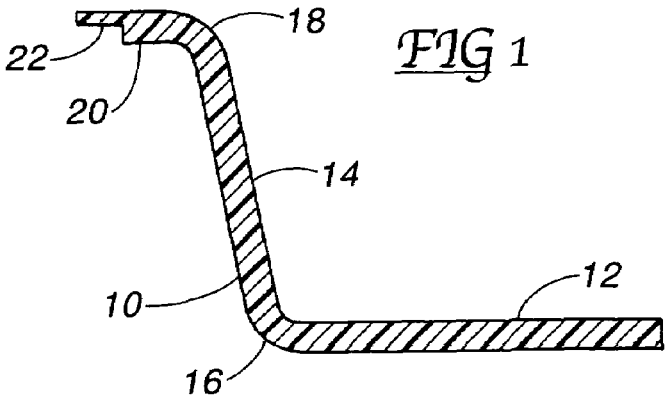
FIG. 1 is a cross-section of the frame extrusion.
Figure 2:
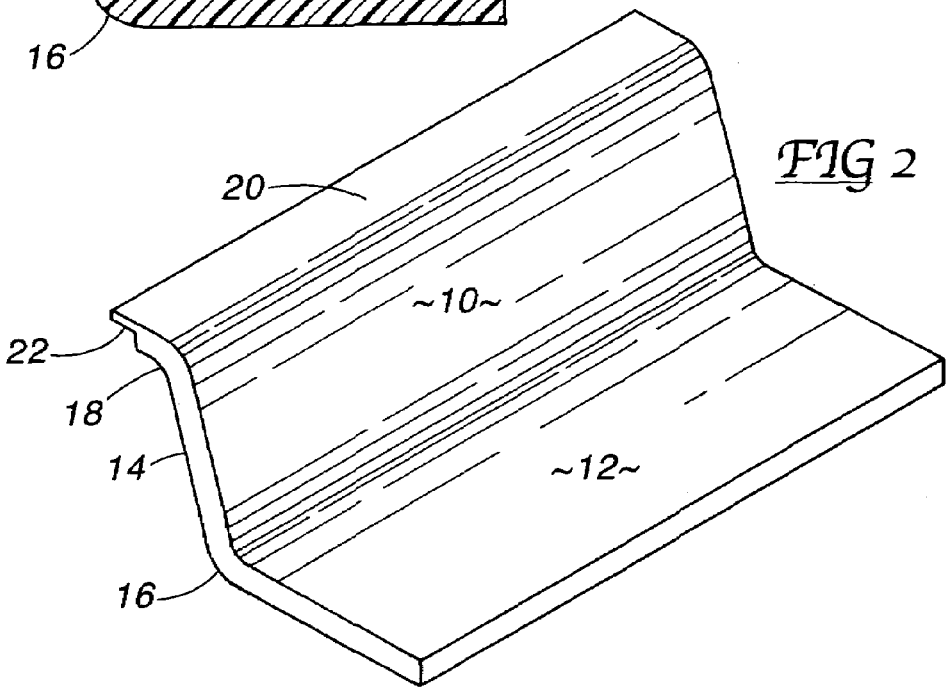
FIG. 2 is a perspective view of the frame extrusion.

As shown in FIGS. 1 and 2, the new frame extrusion 10 comprises a generally L-shape having a generous peripheral portion 12 and a central portion 14 slightly offset from perpendicular to the peripheral portion. The peripheral portion 12 and central portion 14 smoothly curve together at 16, and the central portion smoothly curves at 18 into a relatively narrow lip portion 20. The lip portion 20 is notched at 22 for the attachment of the pan face.

Figure 3:
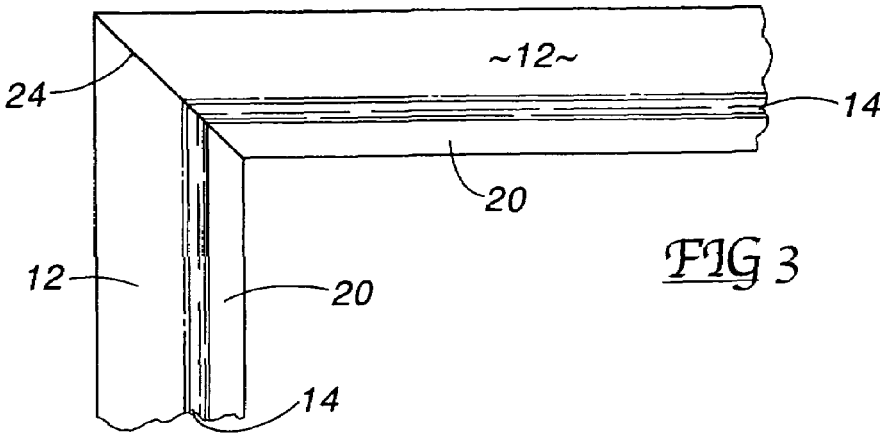
FIG. 3 is a partial cut-away view of a frame miter joint.

The frame extrusion 10 can be manufactured to any length from any suitable material for extrusion, depending on size and strength requirements; however, for most economical common sign applications, an opaque or white translucent polycarbonate plastic is preferred. Corners are simply constructed by miter cutting the extrusions to form corners, as shown in FIG. 3 at 24. The miter cuts can be made with a power miter saw commonly available in a sign shop.

Figure 4:
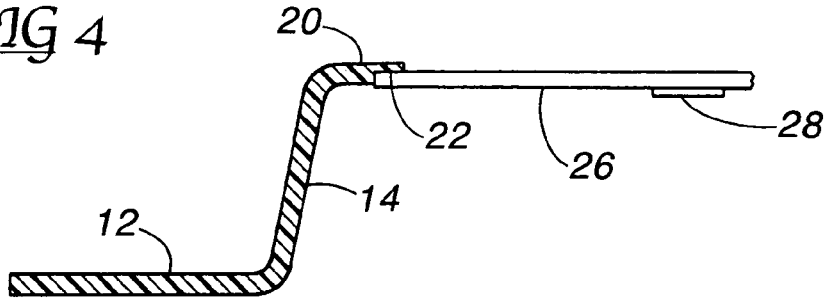
FIG. 4 is a partial cross-section of an assembled pan face sign construction.
Figure 5:
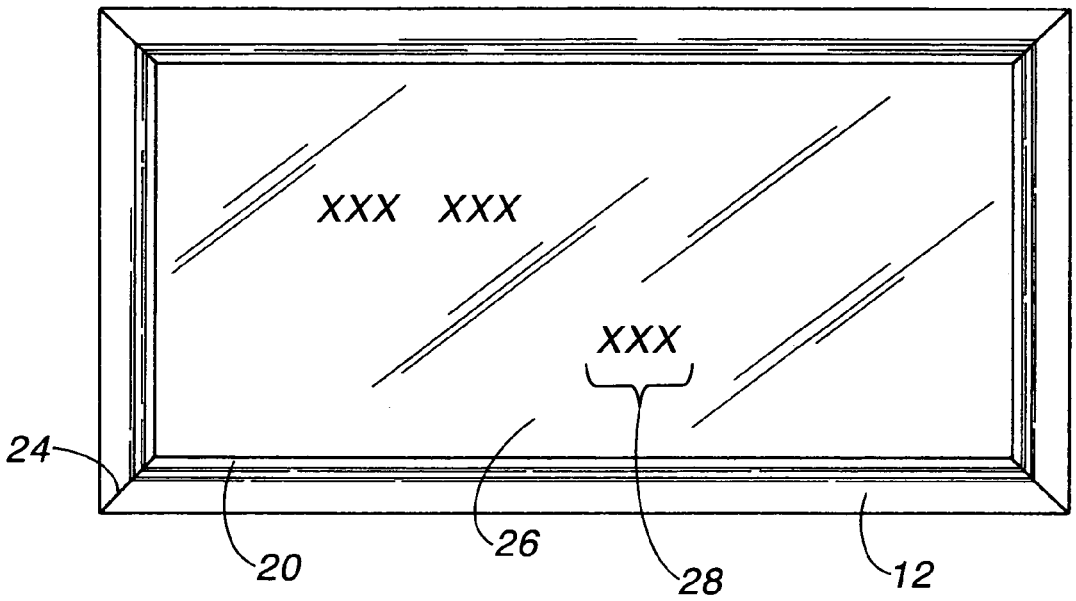
FIG. 5 is a front elevation of a pan face sign construction.

The pan face 26, as shown in FIGS. 4 and 5, of the sign construction comprises a clear acrylic or polycarbonate flat sheet suitable for ink jet printing with newly available ink jet printers and ultraviolet curable inks. The sign printing and graphics can thereby be controlled by a computer and suitable software to automate the sign "painting" process completely. In addition, the printing and graphics can be placed on the backside of the pan face 26 to provide better weather protection for the sign.

Subsequent to placement of the signage 28 on the pan face 26, the frame extrusion 10 pieces are assembled to the pan face with the pan face periphery fitting in the notch 22 of the lip portion 20, as shown in FIG. 4. Assembly can be done by assembling the frame 10 pieces to the pan face 26 with a suitable plastic adhesive applied at the notches 22 and mitered corners 24. Alternatively, the frame 10 pieces can be pre-assembled with adhesive at the mitered corners 24. The pan face 26 can then be dropped into adhesive coated notches 22 subsequent to assembly of the frame 10 pieces.

The invention claimed is:

1. A pan face sign construction comprising a central flat sheet for signage to be applied thereto and a plurality of frame pieces attached to the central flat sheet about the periphery thereof, said frame pieces each having a lip portion, a central portion integral with the lip portion, and a peripheral portion integral with the central portion and parallel to the lip portion, the central portion being slightly offset from perpendicular to the peripheral portion, the lip portion and the peripheral portion extending in opposing directions from the central portion, and the lip portion having a notch integrally formed in a surface thereof and directed toward the peripheral portion, the notch formed to accept the central flat sheet in a plane parallel to the peripheral portion thereby forming the pan face shape of the sign construction.

2. The pan face sign construction of claim 1, including signage applied to the central flat sheet.

3. The pan face sign construction of claim 1 wherein the central flat sheet is central and wherein signage is applied to the back surface of the clear flat sheet.

4. The pan face sign construction of claim 1 wherein the frame pieces are non-clear.

* * * * *